US005689233A

United States Patent [19]

Kurisu et al.

[11] Patent Number: 5,689,233

[45] Date of Patent: Nov. 18, 1997

[54] EMERGENCY INFORMATION OFFERING SYSTEM

[75] Inventors: Hiromitsu Kurisu, Sagamihara; Fuminobu Komura, Yokohama, both of Japan

[73] Assignee: Hitachi, Ltd., Tokyo, Japan

[21] Appl. No.: 507,944

[22] Filed: Jul. 27, 1995

[30] Foreign Application Priority Data

Jul. 29, 1994 [JP] Japan ..... 6-177979

[51] Int. Cl.[6] ..... G08B 29/00

[52] U.S. Cl. ..... 340/506; 340/870.07; 340/870.16; 340/511; 340/517; 340/521; 340/525; 340/531

[58] Field of Search ..... 395/200, 201; 364/431, 138, 146, 188; 376/216, 244, 245; 379/40–45, 37, 38; 340/286.04, 500, 501, 511, 517, 521, 539, 588, 870.07, 870.02, 870.09, 870.16, 525, 531, 506, 825.54; 345/2, 525

[56] References Cited

U.S. PATENT DOCUMENTS

| | | | |
|---|---|---|---|
| 4,521,645 | 6/1985 | Carroll | 340/525 |
| 4,524,354 | 6/1985 | Morgan | 340/525 |
| 4,644,331 | 2/1987 | Matsushita et al. | 340/587 |
| 4,727,359 | 2/1988 | Yuchi et al. | 340/518 |
| 4,749,986 | 6/1988 | Otani et al. | 340/511 |
| 4,749,987 | 6/1988 | Ishii | 340/511 |
| 4,803,039 | 2/1989 | Impink, Jr. et al. | 376/216 |
| 4,962,473 | 10/1990 | Crain | 340/541 |
| 5,185,697 | 2/1993 | Jacobs et al. | 379/45 |
| 5,355,395 | 10/1994 | Kenneth et al. | 376/216 |

FOREIGN PATENT DOCUMENTS 5-183636 7/1993 Japan .

OTHER PUBLICATIONS

Sharma, "Knowledge–based framework for procedure synthesis and its application to the emergency response in nuclear power plant", dissertation, Ohio State Univ., Columnbus, OH, 1986, p.374, Dialog file 103, Accession No. 0195244.

*Primary Examiner*—Gail O. Hayes
*Assistant Examiner*—Frantzy Poinvil
*Attorney, Agent, or Firm*—Fay, Sharpe, Beall, Fagan, Minnich & McKee

[57] ABSTRACT

An emergency information offering system collects and offers information of lifeline facilities upon emergency properly by combining information infra-structures and public infrastructures. In the system, a center monitoring apparatus detects abnormality on the basis of information of the lifeline facilities collected by distributed monitoring apparatuses and meter apparatuses. A risk management apparatus grasps abnormal states and determines countermeasures of abnormality in accordance with the detected abnormality to produce the determined information. A guidance information management apparatus automatically prepares guidance information on the basis of the information and transmits the guidance information to a customer in response to an inquiry. When the guidance information management apparatus detects the congestion of lines, the guidance information management apparatus transmits the guidance information to telephone offices in respective areas, so that a guidance information offering apparatus installed in each office offers the information dispersedly. Thus, common customers can obtain the information relative to the lifeline facilities easily and the information upon emergency can be offered promptly. The congestion of lines due to an excessive amount of inquiries can be avoided.

18 Claims, 10 Drawing Sheets

EMERGENCY INFORMATION OFFERING SYSTEM

BACKGROUND OF THE INVENTION

The present invention relates to working and management of lifeline facilities such as water supply service, electricity supply service, gas supply service and the like, and more particularly to an emergency information offering system for offering information upon emergency to users and persons concerned.

The facilities for the water supply service, the electricity supply service, the gas supply service and the like fulfill the duties as the lifelines indispensable to maintain the daily life and have a mission to function constantly. Accordingly, high reliability is required for its working and management. Particularly, upon occurrence of abnormality or disaster, it is necessary to minimize damage and restore it to the normal state promptly. It is important to exchange proper information in order to perform cooperation between enterprises of the same kind in adjacent areas and between enterprises of the different kind in the same area and connection between associated governing bodies such as a self-governing body, a fire station, a police station and the like closely. Further, it is desirable to report the newest information so that anxiety of the users is reduced and the users do not lead to confusion. In other words, the information offering function is very important in management of the lifeline facilities.

The technique meeting the above-mentioned necessity is described in U.S. Pat. No. 5,185,697 entitled "APPARATUS AND METHOD FOR MANAGING CRISIS SITUATIONS". The above-mentioned U.S. Patent has an object to collect, arrange and offer information in a general wide crisis caused by natural disaster, crime or the like. This system is composed of a command center having a computer and multiple remote units or locations. Information is once collected to the command center by means of any communication means. The information inputted to the computer of the command center is added with a time when the information is obtained and is stored in a file entitled in accordance with contents thereof in time sequence. Further, all files related to the selected file are updated automatically. Then, the information is transmitted to all of the remote units or locations and utilized to update files in the computer of the remote units or locations.

On the other hand, as measures for automatically offering information in response to an inquiry, an electronic switching system disclosed in JP-A-5-183636 may be referred to. In this system, advisory messages for each extension number and time zone are previously stored in the switching system and when there is an incoming call to an extension, the message is selected in accordance with the extension number and the incoming time and is transmitted to a calling terminal.

The lifeline facilities are featured in that equipments such as conduits or power transmission lines are distributed over a wide area and consumers or customers utilizing the equipments are widely distributed similarly. Particularly, in emergency, it is desirable that information of the equipments distributed over a wide area is collected as much as possible and situations are understood exactly to make decision, so that the information is offered. According to the U.S. Pat. No. 5,185,697 described above as the first prior art, if the enterprises of the same kind in adjacent areas, the enterprises of the different kind in the same area and the associated governing bodies such as the self-governing body, the fire station, the police station and the like are supposed to be the remote units or locations, information in the plurality of units or locations each having the computer is shared even in emergency. However, it is difficult to obtain information from a great number of equipments distributed in a wide area as the lifeline facilities, and even means for offering information to many and unspecified users is not constituted. With the electronic switching system described as the second prior art, the telephone network can be utilized to offer information to the many users, while messages are required to be stored previously and accordingly the system cannot be applied upon emergency where situations are varied momently.

SUMMARY OF THE INVENTION

It is an object of the present invention to attain proper information collecting and offering functions by combining information infrastructures and public infrastructures upon emergency of the lifeline facilities.

According to the present invention, means for monitoring facilities and transmitting information thereof are located in a plurality of places distributed in an area where the lifeline facilities exist. Distributed monitoring means are located in primary points in the facilities and meter means are installed in each customer utilizing the facilities, so that information in all parts of the whole facilities can be collected promptly. The collected information is stored in measured information memory means. Area information memory means stores information peculiar to the area where the facilities exist. Center monitoring means detects abnormality on the basis of measured information and area information. Information relative to abnormality which occurred in the past is stored in disaster information memory means. Risk management means grasps abnormal states and determines countermeasure of abnormality on the basis of the measured information, the area information and disaster information. Guidance information management means prepares guidance information for users of the life lines upon emergency on the basis of the information relative to abnormality produced by the risk management means and transmits it to an exclusive line or a public line. The guidance information transmitted to bases of various broadcasting stations and public agencies is edited by guidance information offering means and is offered to the persons concerned and common customers in accordance with requests.

The risk management means predicts a damage and makes a restoration plan on the basis of the information collected upon emergency to determine a policy of countermeasure for emergency. The guidance information management means prepares the guidance information automatically on the basis of the countermeasure for emergency varying with the progress of disaster. A pertinent area is recognized from a calling telephone number of a customer in response to an inquiry by a telephone from the customer and guidance information corresponding to the area is transmitted to the calling party. Latest information can be offered to the customer in response to a request smoothly, so that the information supply side can dedicate itself to restoration works. Further, when many inquiries occur due to a serious disaster and telephone lines are congested, guidance information of each area is transmitted to each telephone office corresponding to each area and guidance information offering means installed together with an exchange system responds to the calling parties directly to thereby reduce the congestion. The same guidance information offering means is installed even in a CATV station to offer the information in response to a request of a subscriber.

Wide area general information can be transmitted to terminals connected to broadcasting equipments of a TV station and a radio station through exclusive lines to thereby be publicly informed immediately by radio. Thus, the information infra-structure can be utilized effectively to offer information exactly.

BRIEF DESCRIPTION OF THE INVENTION

DESCRIPTION OF THE PREFERRED EMBODIMENTS

Figure 1:
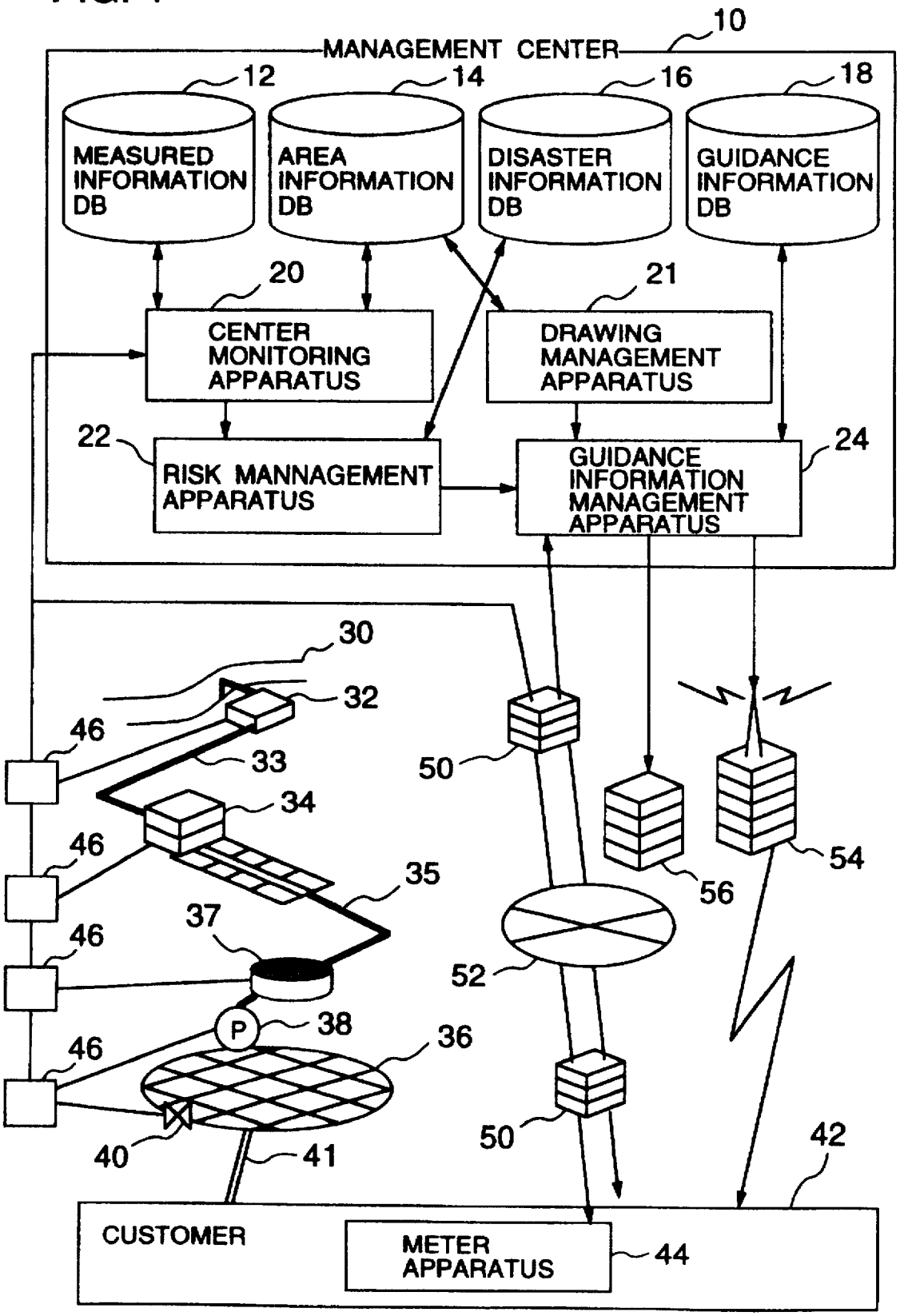
FIG. 1 is a schematic diagram illustrating a whole system in which the present invention is applied to a water supply service.

Embodiments of the present invention are now described with reference to the accompanying drawings. FIG. 1 schematically illustrates a whole system in which the present invention is applied to the water supply service. Water is taken from a river 30 of the source of water supply in an intake plant 32 and is carried through a water conveying path 33 into a water purification plant 34. After water is purified in the water purification plant 34, water is carried through a water conveying path 35 into a distributing reservoir 37 and is stored therein. Water is taken out from the distributing reservoir 37 and pressurized by means of a pump 38 to be sent out through a water pipe net 36 and a service water pipe 41 to a customer 42. A valve 40 is provided in order to ensure a proper water pressure at the customer's location.

A management center 10 has a function of coping with a crisis and offering information to the customers in addition to monitoring and controlling of the above facilities. Information measured in the facilities such as the intake plant 32, the water purification plant 34, the distributing reservoir 37 and the water pipe net 36 is collected through distributed monitoring apparatuses 46 by a central monitoring apparatus 20 and is stored in a measured information data base (DB) 12. Further, equipment data in the facilities, demand data, drawing data, such as piping drawings and the like are stored in an area information data base (DB) 14. Information of the data bases is utilized to calculate proper set operation values for the pump 38 and the valve 40 by the center monitoring apparatus 20 and transmit the calculated values to the distributed monitoring apparatuses 46. The demand data is obtained by periodically accessing a meter apparatus 44 installed in each customer through a telephone office 50 and a public telephone line 52. Stored in a disaster information data base (DB) 16 are various data concerning disasters and the know-how of countermeasures. The information stored in the DB 16 is supplied to a risk management apparatus 22 upon occurrence of a disaster and the risk management apparatus 22 estimates damage and makes a restoration plan on the basis of the estimated damage. A guidance information management apparatus 24 is supplied with data of the estimated damage and the restoration plan and automatically prepares guidance information immediately. Further, the guidance information management apparatus 24 takes in drawing information from the area information DB 14 through a drawing management apparatus 21 if necessary. Wide area information is transmitted to broadcasting facilities 54, such as a radio station and a TV station and public governing bodies 56, such as the Waterworks Bureau of the self-governing body, the public office, the police service and the fire service. On the other hand, detailed information for each area is stored in a guidance information data base (DB) 18. The customer requests access to the guidance information through communication media, such as telephones and CATV. When an inquiry by a telephone is received, the guidance information management apparatus 24 responds to the inquiry by judging a pertinent area from a telephone number of a calling party, selecting guidance information relative to the area and transmitting the information.

Figure 2:
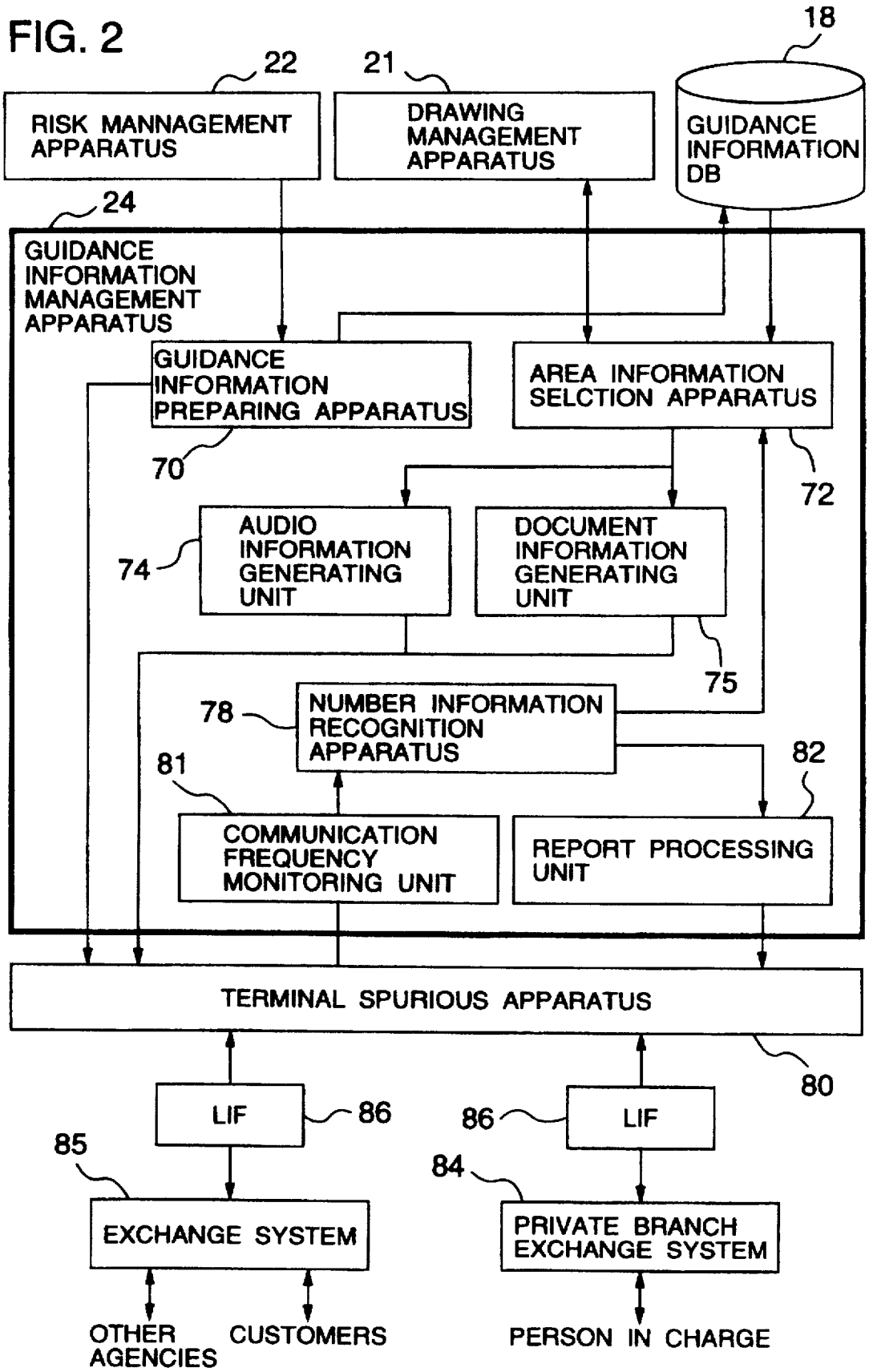
FIG. 2 is a schematic diagram illustrating a guidance information management apparatus in detail.

FIG. 2 schematically illustrates the guidance information management apparatus 24 in detail. The data of the estimated damage and the restoration plan inputted from the risk management apparatus 22 are processed into proper guidance information by a guidance information preparing unit 70. Wide area information is inputted from a terminal spurious apparatus 80 through a line interface 86 to an exchange system 85 and is transmitted from the exchange system to other agencies. Detailed information for each area is stored in the guidance information DB 18. When there is a communication request from a customer, this request is inputted in a number information recognition unit 78, which judges whether the requested communication contents are a report or an inquiry. For example, a telephone number for a report and a telephone number for an inquiry are provided previously and the judgment is made on the basis of a called telephone number. When it is a report, the communication request is processed in a communication processing unit 82. The communication processing unit 82 selects a proper receiver from a list of previously selected receivable persons in charge and sends it to a private branch exchange system 84 together with its extension number so that the customer is connected to a person in charge. When it is an inquiry, a telephone number of a calling party is detected and the telephone number is sent to an area information selection unit 72. The area information selection apparatus 72 judges a corresponding area from the telephone number of the calling party on the basis of information relating the telephone number obtained from the drawing management apparatus 21 to a water pipe network and reads corresponding guidance information from the guidance information DB 18. The read guidance information is converted into a proper information form by an audio information generating unit 74 and a document information generating unit 75 in accordance with the communication request contents and is transmitted to the calling party by means of telephone voice and facsimile information. Communication frequency monitoring means 81 monitors the frequency of communication requests and judges whether the inquiry can be received or not. When the congestion degree of lines reaches the upper limit, the area guidance information is transmitted to the telephone office of the corresponding area, so that the inquiry can be responded in the telephone office to thereby reduce an amount of communication.

Preparation of the guidance information is now described with reference to a definite example. The following guidance information is inputted from the risk management apparatus 22 to the guidance information management apparatus 24.

Case 1

Stage of Abnormality: Water conveying system

Cause of Abnormality: Pollution of first water supply source due to accident of flowing out of industrial oil Estimated Damage: Suspension of water supply from 7:00 to 12:00 for area A and from 7:00 to 10:00 for area B Countermeasure of Restoration: Water supply wagon is provided for area A Case 2

Stage of Abnormality: Water distributing system

Cause of Abnormality: Damage of water supply pipe due to accident in construction of gas pipe Estimated Damage: Red water occurs from 8:00 to 9:00 in part of area C Countermeasure of Restoration: Nothing As described above, the damage situations and restoration plan are inputted in accordance with the stage of the water supply facilities (the water conveying system: from the water intake to the water purification plant, the water sending system: from the water purification plant to the water distributing reservoir, the water distributing system: the water pipe net, and the water supply system: the water supply pipe to the customer). Further, the guidance information DB 18 stores the guidance messages and the correspondence between the estimated damage and the guidance message. An example thereof is described below. There are Nos. 1 and 2 guidance messages as follows:

No. 1: Store water.

No. 2: Restrain water from being used as drinking water.

The correspondence of the estimated damage and the guidance messages is as follows:

(Suspension of water supply—No. 1)

(Red water—No. 2)

The guidance information preparing unit 70 combines the inputted damage situation and the restoration plan with the messages with reference to the correspondence and arranges them for each area. A response is produced from them for each area. An example thereof is described below.

Area A

"The first water supply source is polluted due to the accident of flowing out of industrial oil and abnormality occurs in the water conveying system. Water supply is suspended due to this accident from 7:00 to 12:00. Please store water. A water supply wagon is to be provided."

Area B

"The first water supply source is polluted due to the accident of flowing out of industrial oil and abnormality occurs in the water conveying system. Water supply is suspended due to this accident from 7:00 to 10:00. Please store water."

Area C

"The water distributing pipe is damaged due to an accident in construction of gas pipe and abnormality occurs in the water distributing system. Water becomes turbid to be changed into red water due to this accident from 8:00 to 9:00 and hence water should be restrained from being used as drinking water."

These responses are produced by the audio information generating unit 74 and transmitted to the calling party.

Further, when the responses are transmitted to a particular equipment such as the intake plant, information about the stage corresponding to the equipment is transmitted. In addition, information relative to another associated stage can be also transmitted.

In the present invention, measured data are stored for each area and each stage. Furthermore, these data are related to each other. Accordingly, as described above, information can be transmitted in the various forms.

Figure 3:
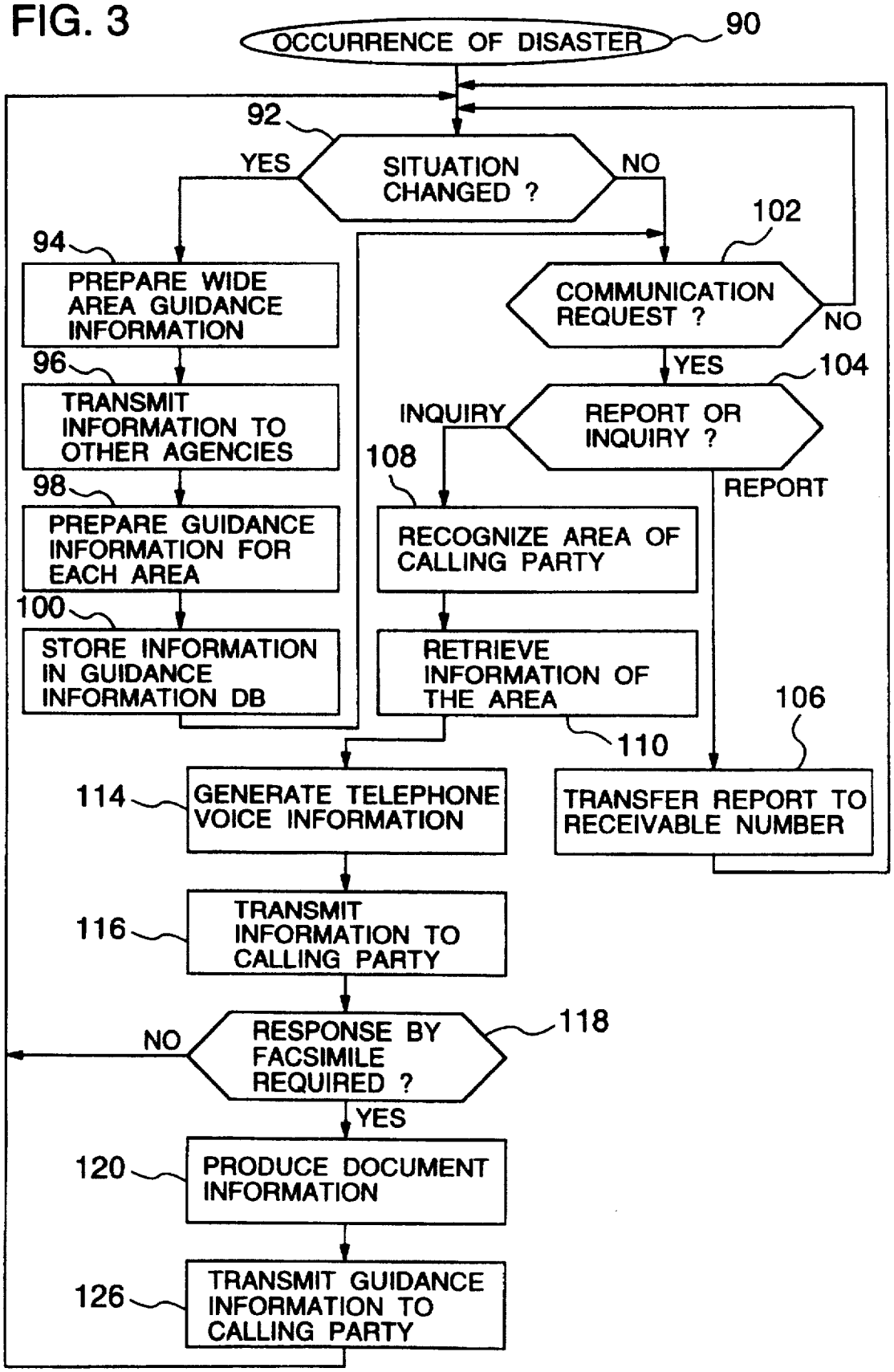
FIG. 3 is a flow chart showing area information offering process.

A procedure of offering the guidance information is shown in a flow chart of FIG. 3. When occurrence of a disaster is detected (step 90), the process is started. Whether the situation is changed as compared with the contents currently guided or not is examined (step 92). When the situation is changed, the wide area information guidance concerning the estimated damage and the restoration plan is prepared (step 94). The wide area information guidance is transmitted to the Waterworks Bureau of the adjacent self-governing body and other agencies such as the public office, the police service and the fire service (step 96). Detailed guidance information for each area is prepared (step 98) and the prepared information is stored in the guidance information DB 18 (step 100). When the situation is not changed, the series of processes 92 to 100 described above are not performed and whether there is a communication request or not is examined (step 102). When there is the communication request, whether it is a report or an inquiry request is determined (step 104). When it is a report, a receivable number is retrieved and the report is transferred to the number (step 106). When it is an inquiry, an area from which the inquiry request is issued is determined on the basis of the number information of the calling party (step 108) and information in the area is retrieved from the guidance information DB (step 110). The guidance information is expressed as telephone voice signal (step 114) and is transmitted to the calling party (step 116). At this time, it is also considered that a telephone number for report, for example, is transmitted together with the guidance information. Further, if it is desired to receive the information by facsimile, guidance is made to send a request code. Subsequently, when a response by a facsimile is required (step 118), the guidance information is expressed in the form of document (step 120) and is transmitted to the calling party (step 126). The transmission process is completed and the process is returned to step 92 again.

The process in the case where the communication request is determined to be a report in step 104 is described in detail. When the report is transferred to a receivable number in step 106, a telephone number of the reporting party is recognized. A pertinent area is determined from the recognized telephone number. The determined area and the report contents are stored in the measured information DB 12 so that the determined area corresponds to the report contents. The information stored in this manner is used to prepare the guidance information in the same manner as the information collected by the distributed monitoring apparatus 46.

Further, in the present invention, the wide area guidance information or the local guidance information can be selected in accordance with the telephone number for the wide area inquiry and be transmitted. For example, when the inquiry is made from a common home, the local guidance information in an area where the home exists is transmitted. Further, when the inquiry is made from the public agency, such as a police service, the wide area guidance information is transmitted. In addition, for the public agency, the local information in the area where the public agency exists can be also transmitted together with the wide area information.

Furthermore, in the present invention, the information (measured information and reported information) collected as described above may be newly stored in the disaster information DB 18. In addition, the actually used guidance information and the reaction of the customer to the guidance information may be stored in the disaster information DB 18, so that the information at this time can be reflected in a next emergency.

Figure 4:
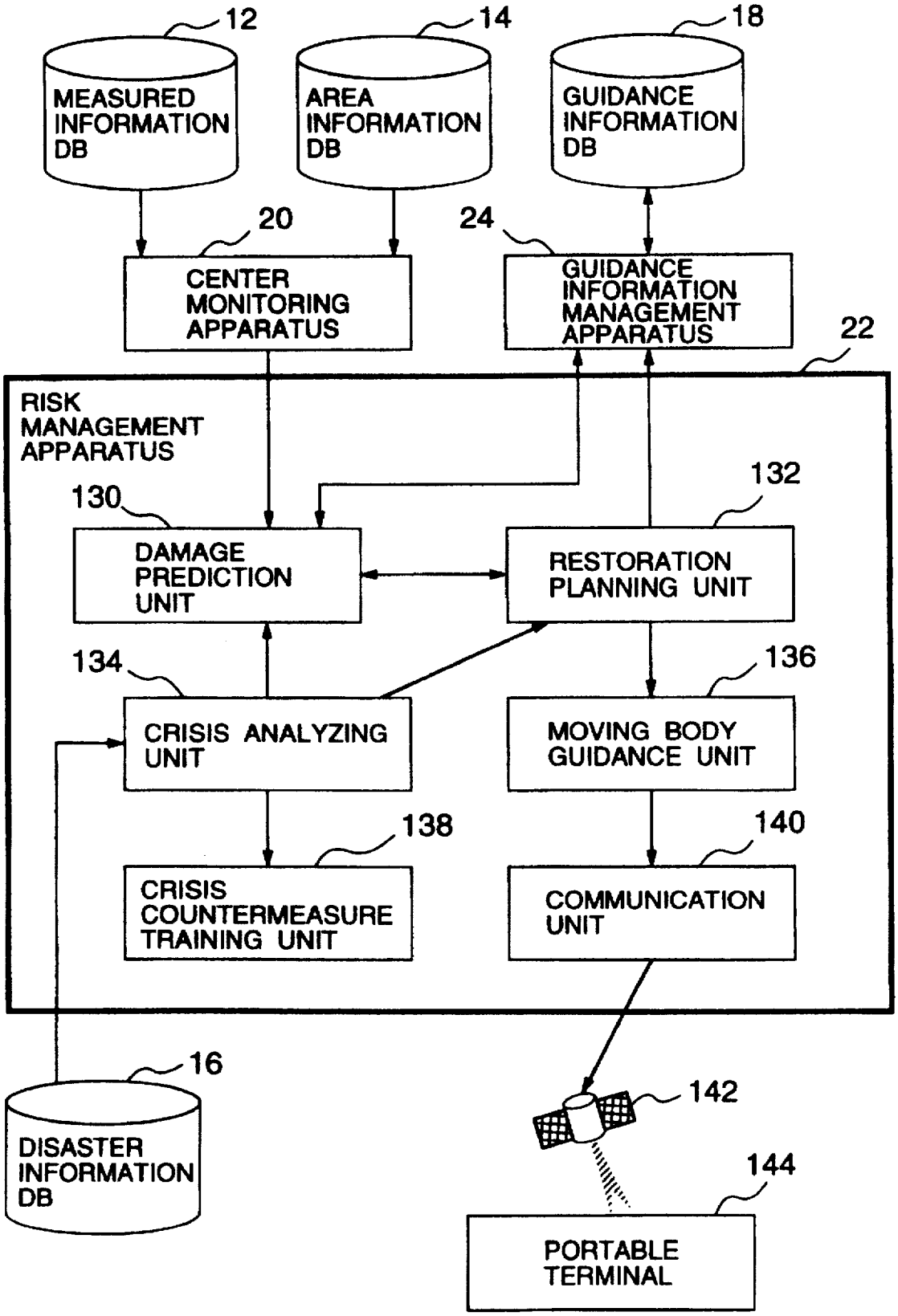
FIG. 4 is a schematic diagram illustrating a risk management apparatus in detail.

Referring now to FIG. 4, the risk management apparatus 22 for performing determination of contents of the guidance information, that is, prediction of damage and planning of restoration is described in detail. A crisis analyzing unit 134 analyzes dangerous degrees of each area and each equipment from the past disaster information and sends the analyzed results to a damage prediction unit 130 and a restoration planning unit 132. The damage prediction unit 130 predicts damage on the basis of various measured information and area information obtained from the monitoring control apparatus 20 and the analyzed results by the crisis analyzing unit 134. Further, the planned results by the restoration planning unit 132 are also fed back to aid the prediction. The restoration planing unit 132 makes a restoration plan on the basis of the predicted results by the damage prediction unit 130 and the analyzed results by the crisis analyzing unit 134. The restoration plan value is also sent to a moving body guidance unit 136. The moving body guidance unit 136 produces indications to operators working outside on the basis of the plan. The indications to the operators are transmitted from a communication unit 140 through a communication satellite 142 to portable terminals 144 carried by the operators. In the normal state, a crisis countermeasure training unit 138 supports training of workers by utilizing the analyzed results by the crisis analyzing apparatus 134.

Figure 5:
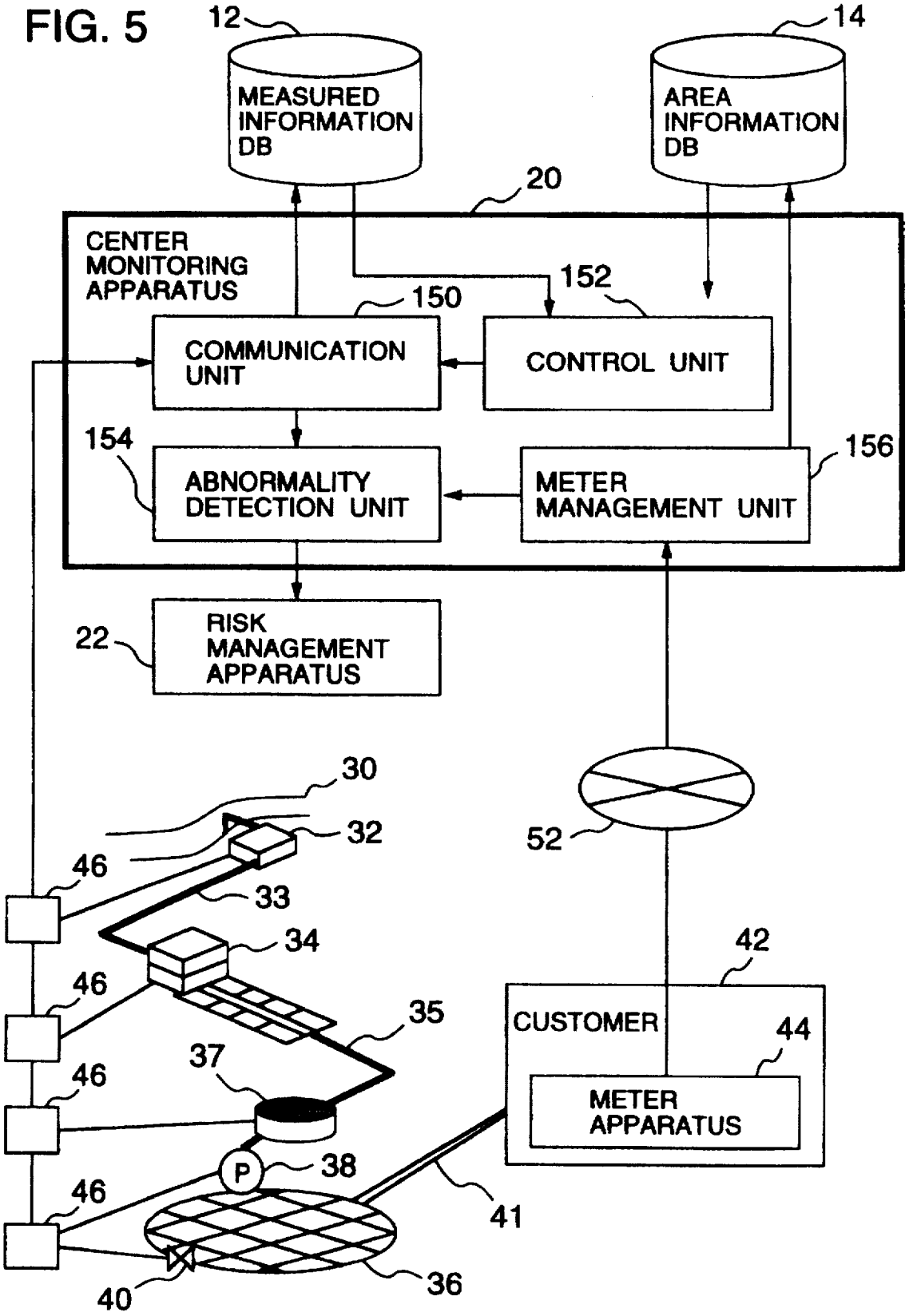
FIG. 5 is a schematic diagram illustrating a center monitoring apparatus in detail.

The risk management apparatus is required to provide strong information collecting means in order to exhibit its function. The central monitoring apparatus 20 for fulfilling the duties therefor is now described in detail. FIG. 5 schematically illustrates an internal configuration of the central monitoring apparatus 20 and a portion relating to collection of information. The central monitoring apparatus 20 includes a communication unit 150, a control unit 152, an abnormality detection unit 154 and a meter management unit 156. The communication unit 150 is connected through an exclusive line to the distributed monitoring apparatuses 46 for the equipments to transmit the measured information and the control command value. The exclusive line is desired to be a radio line in order to cope with the emergency. The collected measured information is stored in the measured information DB 12. The control command value is calculated by the control unit 152 on the basis of information stored in the measured information DB 12 and the area information DB 14. The abnormality detection unit 154 monitors the equipments on the basis of the collected measured information and transmits the measured information to the risk management apparatus 22 immediately when any abnormality is detected. The meter management unit 156 periodically accesses to the meter apparatus 44 installed in the customer 42 through a public line 52 and converts the obtained result into demand data, which is stored in the area information DB 14. Further, the monitored result by the meter apparatus 44 is read and transmitted by means of the polling limited to the estimated damage area upon occurrence of disaster. The abnormality detection unit 154 analyzes the monitored input result of the customer 42 and transmits the monitored result to the risk management apparatus 22 immediately when any abnormality is detected.

Figure 6:
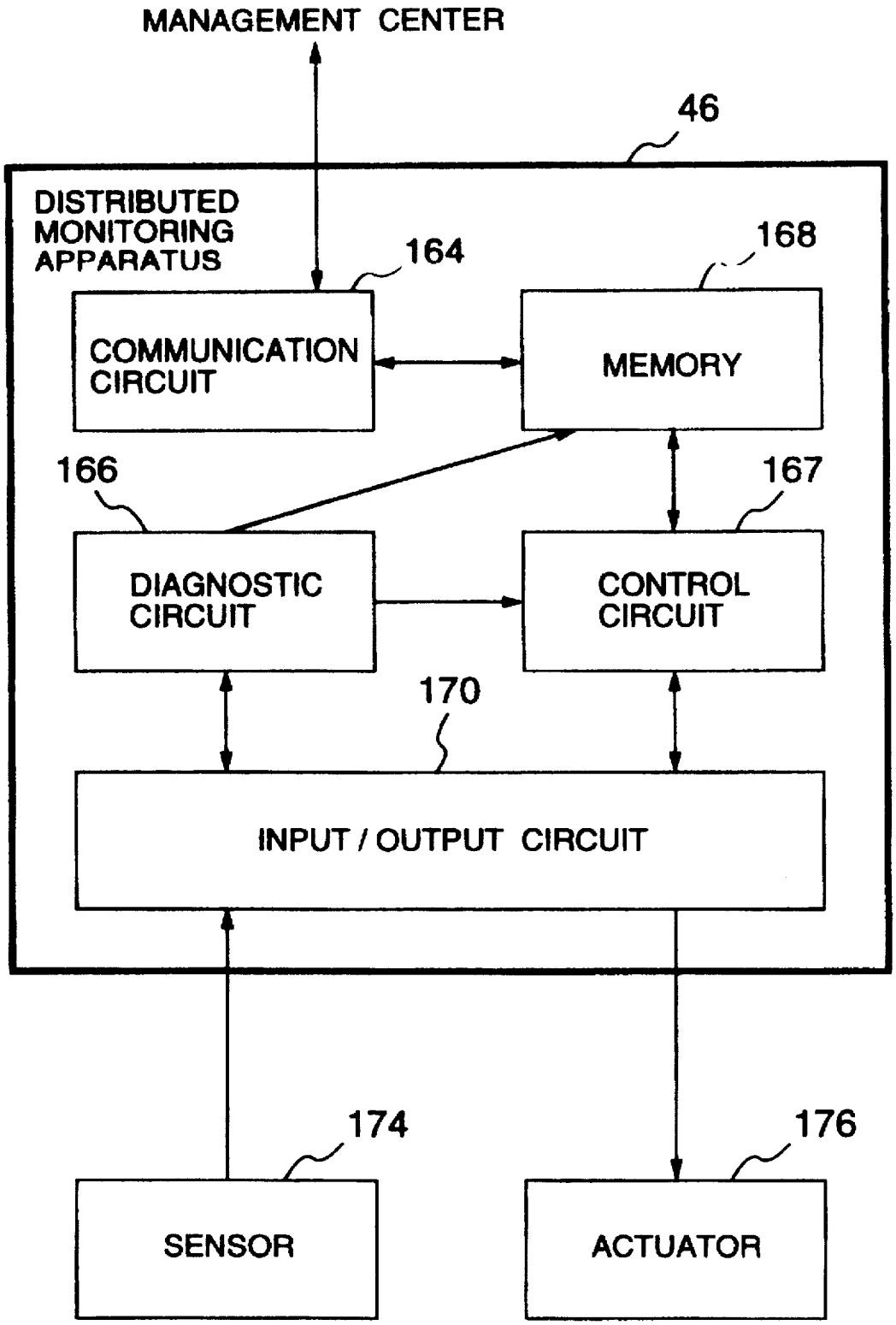
FIG. 6 is a schematic diagram illustrating a distributed monitoring apparatus in detail.

FIG. 6 schematically illustrates the distributed monitoring apparatus 46. A communication circuit 164 receives a control set value transmitted from the management center and stores it in a memory 168. Further, the communication circuit reads a measured value and an abnormality diagnostic value stored in the memory 168 and transmits them to the management center. A diagnostic circuit 166 receives a measured value by a sensor 174, such as a water quantity meter, a water pressure meter, a water quality meter or the like through an input/output circuit 170 and makes diagnosis of abnormality, so that the measured value and the abnormality diagnostic value are stored in the memory 168. The measured value is also sent to a control circuit 167. The control circuit 167 receives the measured value and the control set value and sends a control signal based on these values to an actuator 176, such as a pump or a valve.

As described above, the management center 10 uses both of the control set value taking the whole lifeline facilities into consideration and the measured value indicative of situations peculiar to the facilities to perform control. Thus, the whole lifeline facilities can be balanced and situations of the facilities can be treated with finely.

Further, in the case of a particularly dangerous situation even in the emergency, the system can cope with it as follows. When the sensor 174 detects an emergency situation, the control set value inputted from the management center 10 is neglected and control is made on the basis of information relative to the emergency situation previously stored in the memory 168. The information relative to the emergency situation contains information relative to control such as closure of a pump in the case where a certain component exceeds a predetermined value. With such a configuration, the system can cope with the particularly dangerous case promptly.

Figure 7:
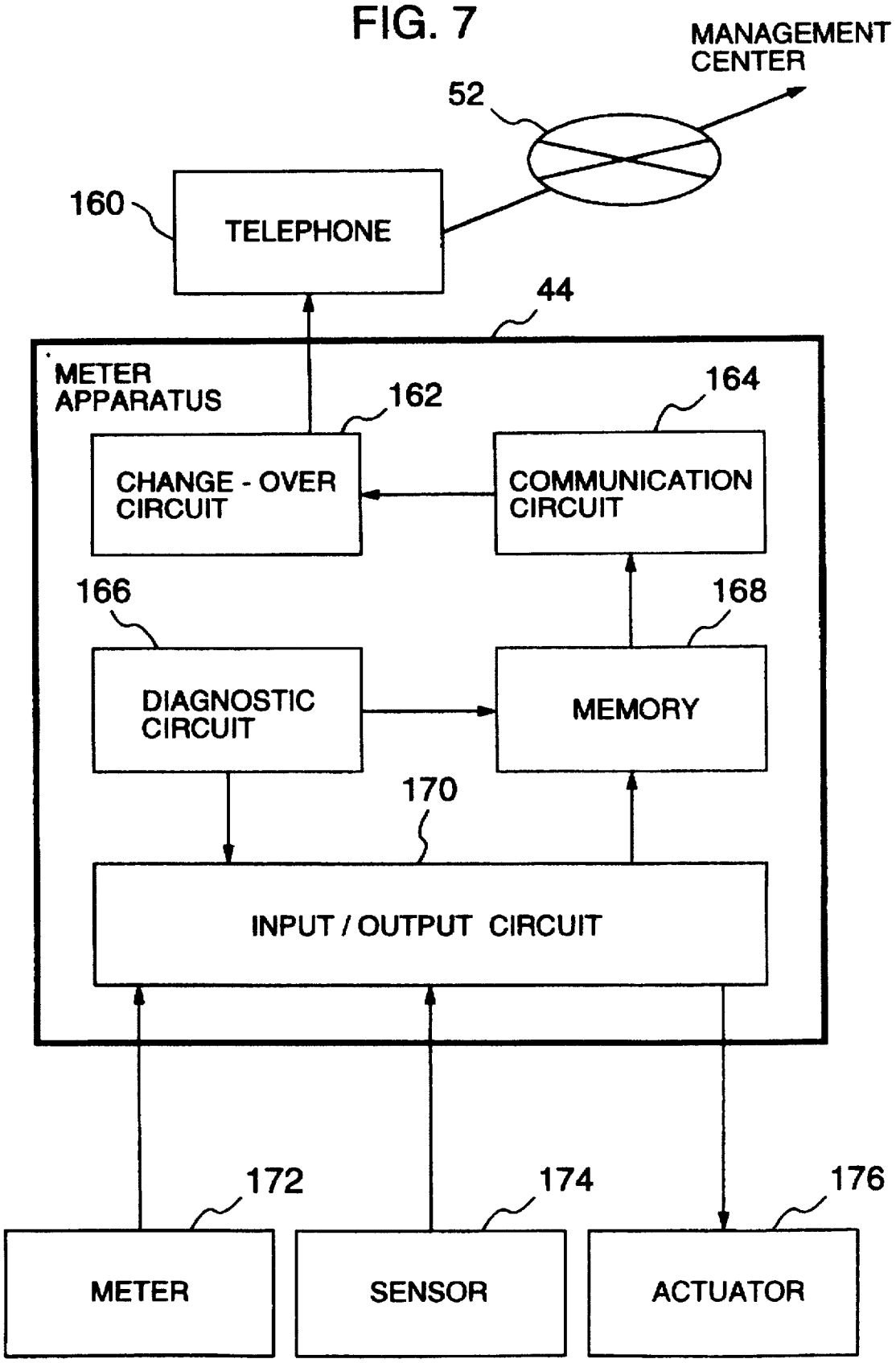
FIG. 7 is a schematic diagram illustrating a meter apparatus in detail.

FIG. 7 schematically illustrates the meter apparatus 44. The meter apparatus 44 is connected to a telephone 160 of the customer. A change-over circuit 162 detects calling party's number information of a communication request signal received by the telephone 160 and collates it with a number list previously registered in a memory 168. When the detected number is contained in the list, ringing of a bell is suppressed and a communication circuit 164 is connected to the telephone 160 so that the management center can access to the memory 168 through the communication circuit 164. A diagnostic circuit 166 receives a meter value from a meter 172 through an input/output circuit 170 at a previously set time and stores it in the memory 168. Further, the diagnostic circuit 166 performs diagnosis of abnormality on the basis of an input from the sensor 174 and stores an occurrence time of abnormality and abnormality contents in the memory 168. The diagnostic circuit 166 controls the actuator 176 on the basis of the stored information and diagnostic contents of abnormality. In the normal state, the management center 10 accesses to the meter apparatus 44 periodically to obtain demand data. However, when abnormality occurs, abnormality information containing the occurrence time of abnormality and the abnormality contents is transmitted to the management center 10 without relation to the above access. For example, when the diagnostic result indicates very dangerous as unusual water quality due to mixture of poisonous substance, emergency cutting off is performed by the actuator 176.

Figure 8:
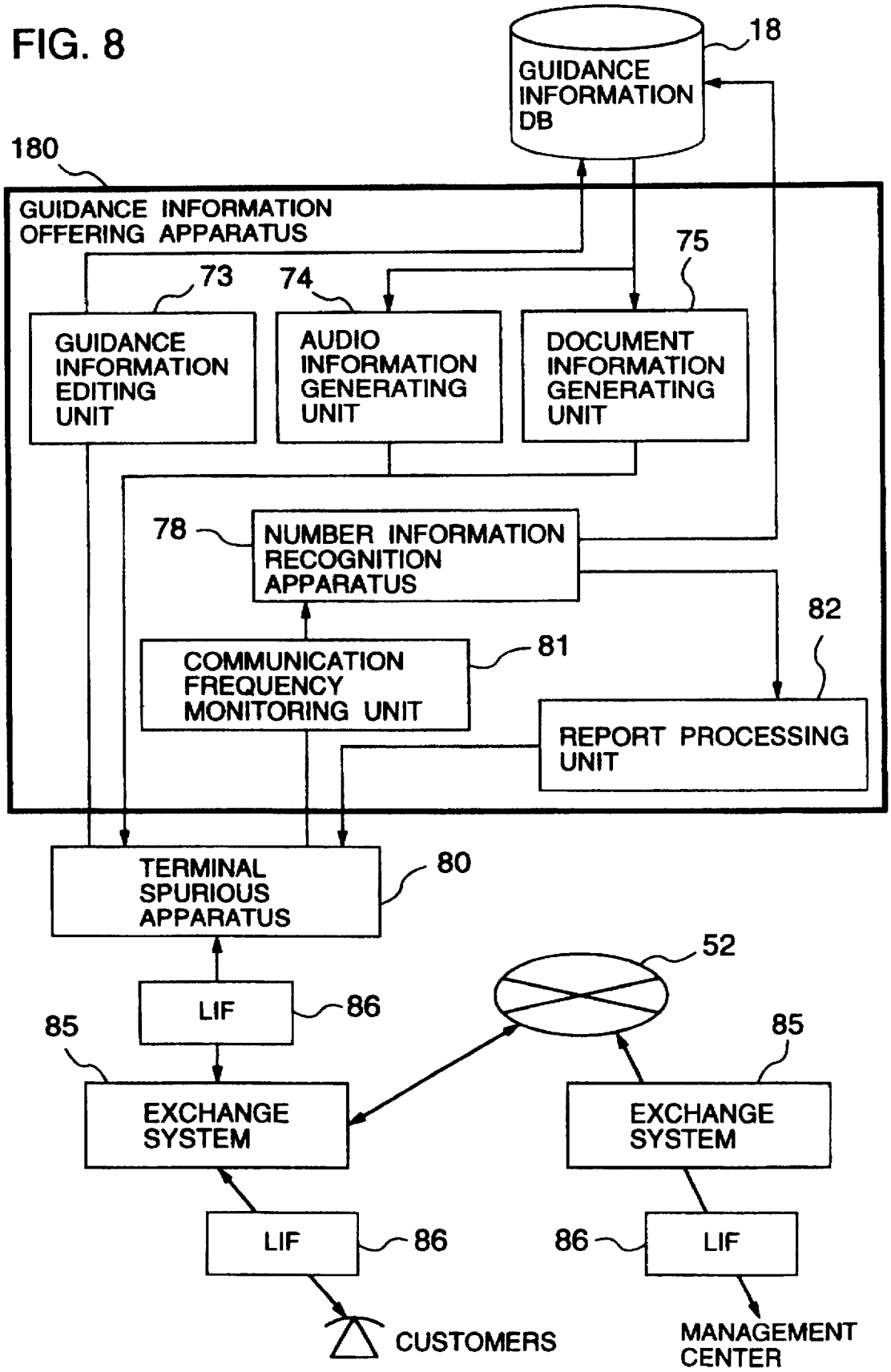
FIG. 8 is a schematic diagram illustrating a guidance information offering apparatus installed in a telephone office in detail.

FIG. 8 schematically illustrates a guidance information offering apparatus 180 installed in a telephone office in detail. A communication request from the customer is inputted to the exchange system 85 through the line interface 86 and when the number list registered in the exchange system is coincident to a receiving party, the communication request is inputted through the line interface 86 to the terminal spurious apparatus 80. The number information recognition unit 78 detects a telephone number of the calling party and transmits it to the area information selection apparatus when a telephone number of the receiving party is for an inquiry of the guidance information. When the receiving party has a telephone number for a report, the number information recognition unit 78 sends the telephone number of the calling party to the report processing unit 82. The area information selection apparatus 72 identifies an area of the calling party from the telephone number of the calling party and reads pertinent area information from the area information DB 18. The latest guidance information received from the management center is stored in the area information DB 18. When a plurality of pieces of guidance information are received from management centers for other lifeline facilities, such as the gas supply service, the electricity supply service and the like in addition to the water supply service, a guidance information editing unit 73 edits the guidance information and stores it into the area information DB. The voice information generating unit 74 and the document information generating unit 75 convert the area information into proper audio information and document information and transmits them to the customer of the calling party. The communication frequency monitoring means 81 monitors the frequency of communication requests and judges whether an inquiry can be received or not. When the congestion degree of lines reaches the upper limit, the message indicating that the line connection is impossible is transmitted even for the report request communication.

Figure 9:
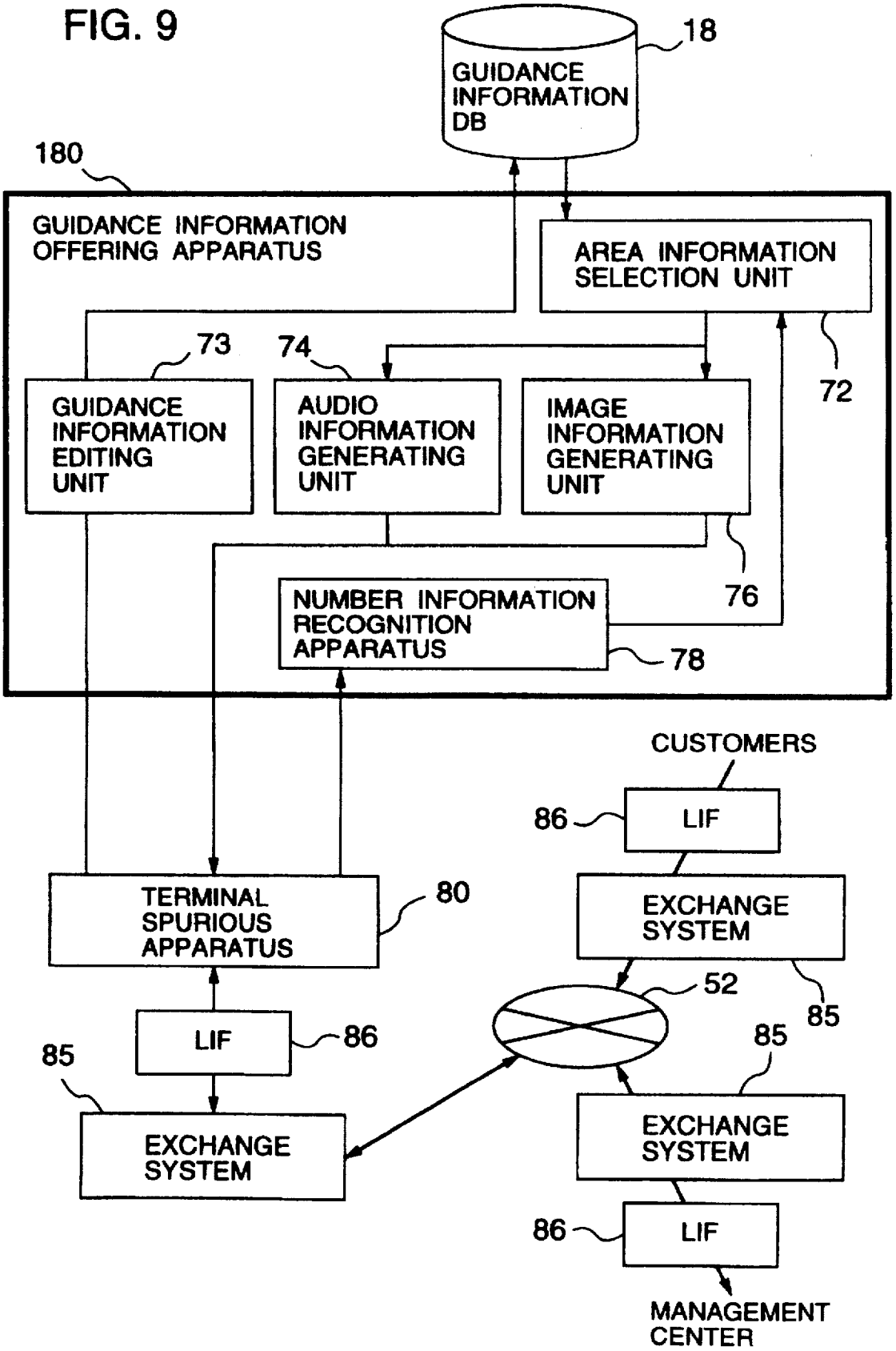
FIG. 9 is a schematic diagram illustrating a guidance information offering apparatus installed in a CATV station in detail.

FIG. 9 schematically illustrates the guidance information offering apparatus 180 installed in a CATV station in detail. The communication request from the customer is inputted through the line interface 86 and the exchange system 85 to the terminal dummy apparatus 80. The number information recognition unit 78 detects the number of the calling party and transmits it to the area information selection unit 72. The area information selection unit 72 identifies an area of the calling party from the number of the calling party and reads pertinent area information from the area information DB 18. Latest guidance information received from the management center is stored in the area information DB 18. When a plurality of pieces of guidance information are received from management centers for other lifeline facilities, such as the gas supply service, the electricity supply service and the like in addition to the water supply service, the guidance information editing unit 73 edits the guidance information and stores it into the area information DB. The audio information generating unit 74 and an image information generating unit 76 convert the area information into proper voice information and image information and transmit them to the customer of the calling party.

Figure 10:
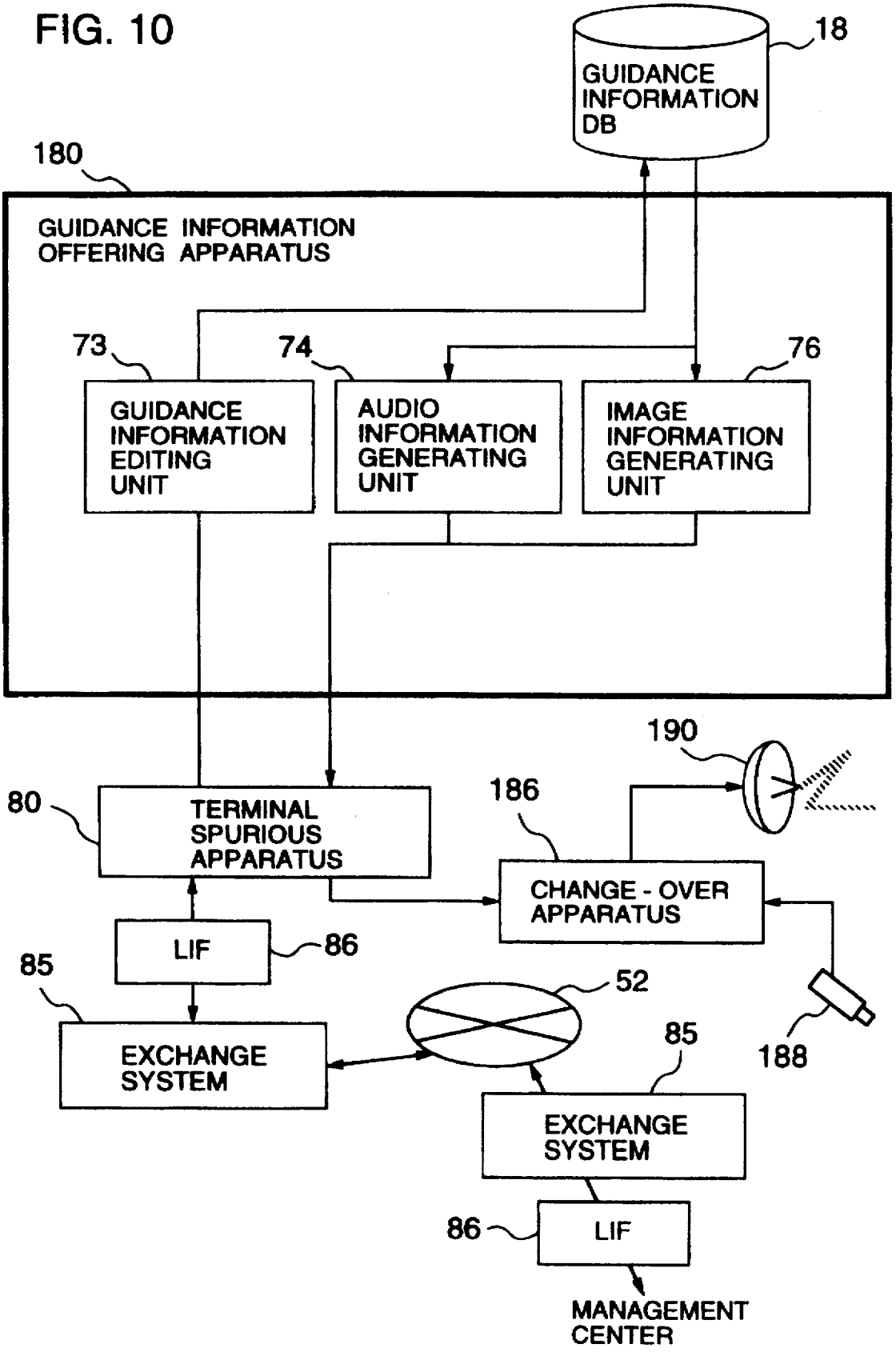
FIG. 10 is a schematic diagram illustrating a guidance information offering apparatus installed in a TV station.

FIG. 10 schematically illustrates the guidance information offering apparatus 180 installed in a TV station in detail. Latest guidance information received from the management center is stored in the area information DB 18. When a plurality of guidance information items are received from management centers for other lifeline facilities, such as the gas supply service, the electricity supply service and the like in addition to the water supply service, the guidance information editing unit 73 edits the guidance information and stores it in the area information DB. The voice information generating unit 74 and the image information generating unit 76 convert the guidance information into proper audio information and image information and input them to the terminal dummy apparatus 80. The terminal dummy apparatus 80 is connected through a change-over apparatus 186 to a broadcasting equipment 190. The change-over apparatus 186 switches or mixes image information sent from an imaging equipment 188 and guidance information sent from the terminal dummy apparatus 80 properly and sends the result thereof to the broadcasting equipment 190.

According to the present invention, the common customer can easily obtain the information relative to the lifeline facilities and the information upon emergency can be offered promptly. Further, the congestion of lines due to an excessive amount of inquiries can be avoided.

We claim:

1. An emergency area information offering system for monitoring situations at predetermined places in lifeline facilities and offering information relative to the lifeline facilities upon emergency on the basis of the monitored results, comprising:

monitoring means located in a plurality of places distributed in an area where the lifeline facilities exist to monitor the facilities and transmitting information representative of results of the monitor;

measured information memory means for storing measured information transmitted from said monitoring means;

area information memory means for storing area information unique to the area where the facilities exist;

central monitoring means combined with said measured information memory means and said area information memory means, for detecting abnormality on the basis of said transmitted information and said information unique to the area;

disaster information memory means for storing disaster information relative to abnormality having occurred in the past;

risk management means for grasping abnormal states and determining countermeasures of abnormality on the basis of said measured information, said area information and said disaster information;

guidance information management means for preparing and offering guidance information for users of lifelines upon emergency on the basis of information relative to abnormality issued from said risk management means; and guidance information memory means combined with said guidance information management means for storing said prepared guidance information.

2. An emergency area information offering system according to claim 1, wherein said monitoring means includes distributed monitoring means located at primary points in the facilities and meter means located in each customer using the facilities.

3. An emergency area information offering system according to claim 2, wherein said distributed monitoring control means includes input/output means for receiving a signal measured by a sensor and sending a command signal to an actuator, control means for determining an operation amount of said actuator on the basis of said measured signal and a control set value transmitted externally, diagnostic means for judging abnormality of said measured signal, memory means for temporarily storing the control set value transmitted externally, the measured signal by said sensor and an abnormality detection signal by said diagnostic means, and communication means for transmitting information stored in said memory means.

4. An emergency area information offering system according to claim 2, wherein said meter means includes input/output means for receiving measured signals from a meter and a sensor and sending a command signal to an actuator, memory means for temporarily storing the measured signals from said meter and sensor, communication means for transmitting information stored in said memory means, and circuit change-over means for suppressing ringing of a bell of a telephone and connecting said telephone to said communication means when an external communication request is detected.

5. An emergency area information offering system according to claim 1, wherein said guidance information management means includes guidance information preparing means for preparing the guidance information for the users of the lifelines upon emergency on the basis of information related to abnormality issued from said risk management means, number information recognition means for detecting number information of a receiving party and a calling party of a communication request received through a line, area information selection means for selecting and sending guidance information of an area pertinent to the calling party on the basis of the calling party's number, and report processing means for converting the receiving party's number information into connectable number information.

6. An emergency area information offering system according to claim 1, wherein said guidance information management means includes guidance information preparing means for preparing the guidance information for the users of the lifelines upon emergency on the basis of information related to abnormality issued from said risk management means, and guidance information offering means located in a plurality of places for offering guidance information transmitted from said guidance information preparing means to the users of the lifelines.

7. An emergency area information offering system according to claim 6, wherein said guidance information offering means includes guidance information editing means for editing the guidance information prepared by said guidance information preparing means, number information recognition means for detecting number information of the calling party and the receiving party of a communication request received through a line, and report processing means for converting the receiving party's number information into connectable number information, and said guidance information offering means are located in a plurality of offices in a telephone line network.

8. An emergency area information offering system according to claim 6, wherein said guidance information offering means includes guidance information editing means for editing the guidance information prepared by said guidance information preparing means, number information recognition means for detecting the calling party's number information of a communication request received through a line, and area information selecting means for selecting and sending guidance information of an area pertinent to the calling party on the basis of the calling party's number, and said guidance information offering means is located in a CATV station.

9. An emergency area information offering system according to claim 6, wherein said guidance information offering means includes means for temporarily storing the guidance information prepared by said guidance information preparing means and is connected to broadcasting means.

10. An emergency area information offering system according to claim 1, wherein said risk management means includes crisis analyzing means for analyzing information upon emergency in the past, damage prediction means for grasping current and future damage situations on the basis of analyzed results by said crisis analyzing means and measured information by said center monitoring means, restoration planning means for planing restoration measures in accordance with the damage situations, moving body guidance means for determining indication to workers on the basis of the restoration plan, communication means for transmitting the indication to portable information processing means carried by the workers through a communication satellite, and crisis countermeasure training means for supporting crisis countermeasure training on the basis of the analyzed results of information upon emergency in the past.

11. An emergency area information offering system according to claim 1, wherein said central monitoring means includes remote measurement control means for collecting measured information from primary points in the lifeline facilities and transmitting a control set value to said primary points, control means for determining the control set value on the basis of collected measured information, meter management means for processing measured information and meter information from customers using the facilities, and monitoring means for detecting the abnormal states from the measured information.

12. An emergency area information offering system according to claim 1, comprising guidance information preparing means for preparing the guidance information for the users of the lifelines upon emergency on the basis of the information relative to the abnormality, guidance information memory means for storing the prepared guidance information, number information recognition means for detecting number information of a receiving party and a calling party of a communication request received through a line, area information selection means for retrieving guidance information of an area pertinent to the calling party from the guidance information stored in said guidance information memory means on the basis of the calling party's number, and report processing means for converting the receiving party's number information into connectable number information.

13. An emergency area information offering system according to claim 12, comprising guidance information offering means located in a plurality of places for offering the guidance information transmitted from said guidance information preparing means to the users of the lifelines.

14. An emergency area information offering system according to claim 13, wherein said guidance information offering means includes guidance information editing means for editing the guidance information by said guidance information preparing means, number information recognition means for detecting number information of the calling party and receiving party of the communication request received through the line, and report processing means for converting the receiving party's number information into connectable number information, and are located in a plurality of offices in a telephone line network.

15. An emergency area information offering system according to claim 13, wherein said guidance information offering means includes guidance information editing means for editing the guidance information by said guidance information preparing means, number information recognition means for detecting number information of the calling party of the communication request received through the line, and area information selection means for selecting and sending guidance information of an area corresponding to the calling party on the basis of the calling party's number, and are located in a CATV station.

16. An emergency area information offering system according to claim 13, wherein said guidance information offering means includes means for temporarily storing the guidance information by said guidance information preparing means and is connected to broadcasting means.

17. An emergency area information offering system according to claim 12, comprising communication request amount monitoring means for monitoring a frequency of incoming calls by telephone lines and changing over to respond to inquiries concentratedly or dispersedly, and guidance information offering means located in a plurality of places for offering the guidance information transmitted from said guidance information preparing means to the users of the lifelines.

18. An emergency area information offering system according to claim 17, comprising a data base in which a lifeline facility disposition network and telephone numbers of the customers are related to each other and wherein when the customer requires information of the area through the line upon emergency, area information corresponding to the area of the calling party is offered on the basis of the telephone number or the telephone office number of the calling party.

* * * * *